US006498587B1

(12) United States Patent
Desclos et al.

(10) Patent No.: US 6,498,587 B1
(45) Date of Patent: Dec. 24, 2002

(54) COMPACT PATCH ANTENNA EMPLOYING TRANSMISSION LINES WITH INSERTABLE COMPONENTS SPACING

(75) Inventors: Laurent Desclos, Los Angeles, CA (US); Gregory Poilasne, Los Angeles, CA (US); Sebastian Rowson, Santa Monica, CA (US)

(73) Assignee: Ethertronics Inc., San Diego, CA (US)

( * ) Notice: Subject to any disclaimer, the term of this patent is extended or adjusted under 35 U.S.C. 154(b) by 0 days.

(21) Appl. No.: 09/880,535

(22) Filed: Jun. 13, 2001

(51) Int. Cl.[7] ..... H01Q 1/38

(52) U.S. Cl. ..... 343/700 MS; 343/770; 343/909; 333/202

(58) Field of Search ..... 343/700 MS, 767, 343/770, 756, 909; 333/134, 202, 246

(56) References Cited

U.S. PATENT DOCUMENTS 4,475,107 A * 10/1984 Makimoto et al. ... 343/700 MS
4,918,457 A * 4/1990 Gibson ..... 343/700 MS
5,006,858 A * 4/1991 Shirosaka ..... 343/700 MS
5,045,862 A * 9/1991 Alden et al. ..... 343/700 MS
5,923,295 A * 7/1999 Nakano et al. ..... 343/700 MS
6,037,525 A * 3/2000 Bateman ..... 435/320.1

OTHER PUBLICATIONS

The New World of Communications Design Software, Ansoft Corporation—Ansoft Designer Article—Microwave Journal http://www.ansoft.com/news/articles/Microwave_Journal_art03_01.cfm 5 pages.

* cited by examiner

*Primary Examiner*—Tan Ho
(74) *Attorney, Agent, or Firm*—Fernandez & Associates, LLP

(57) ABSTRACT

The invention discloses a patch antenna structure in which a full transmission line is replaced by a set of transmission lines connected between two slots or radiative elements. Components can be inserted in the space between the transmission lines. In a second embodiment, the transmission lines are cranked or bended for a more compact dimension of transmission lines. The cranked or bended transmission lines can also be loaded by inductive elements. In a third embodiment, a patch antenna is constructed with n sets of transmission lines between the two slots, where each set of transmission line produces a different electrical length in accordance with a particular frequency. In a fourth embodiment, a set of intermediate filters is added within the transmission lines for differentiating the frequencies.

10 Claims, 11 Drawing Sheets

110

COMPACT PATCH ANTENNA EMPLOYING TRANSMISSION LINES WITH INSERTABLE COMPONENTS SPACING

BACKGROUND INFORMATION

1. Field of the Invention

The present invention relates to the field of wireless communications, and more particularly to patch antennas.

2. Description of Related Art

Wireless devices have become an integral life style among mobile professionals and consumers worldwide. Users of wireless devices demand a more compact, yet powerful cellular phones, mobile devices, and personal digital assistants (PDAs). One approach to reduce the overall size of a wireless device is to reduce the dimension of a patch antenna. FIG. 1 illustrates a conventional patch antenna 10 having a first slot 11 and a second slot 13 interconnected with each other by a full transmission line 12. The first slot 11 and the second slot 13 operate as the two primary radiators in the mechanism of the patch antenna 10. The full transmission line 12, typically implemented as a half wavelength, is placed between the first slot 11 and the second slot 13, ensuring that the first slot 11 and the second slot 13 will be fed by a $\lambda_g/2$ decay in order to extract the maximum efficiency from the patch antenna structure 10.

An equivalent circuit 20 representing the patch antenna 10 is shown in FIG. 2. The equivalent circuit 20 is constructed with capacitors 21 and 22, resistors 23 and 24, and inductors 25 and 26. The capacitors 21 and 22 denote the fringing capacitance, the resistors 23 and 24 denoting the radiative resistance, and the elements 25 and 26 denoting a decay representing a transmission line.

A typical delay of $\lambda_g/2$ is often necessary to attain maximum efficiency. A way to reduce the dimension of a patch is to make decay in less space by a fictive $\lambda_g/2$. One conventional approach to increase the amount of delay in a given space of a transmission line is by loading the transmission line either capacitively or inductively, as described, for example, in S. Reed, L. Desclos, C. Terret, S. Toutain, "Patch Antenna Size Reduction by Inductive Loading", in Microwave Optical Technology Letters April 2001.

Accordingly, it is desirable to have structures and methods of an antenna that is compact in size while attaining maximum efficiency.

SUMMARY OF THE INVENTION

The invention discloses a full transmission line replaced by a set of transmission lines connected between two slots or radiative elements. Components can be inserted in the space between the transmission lines. In an alternative embodiment, the transmission fines are cranked or bended for a more compact dimension of transmission lines. The cranked or bended transmission lines can also be loaded by inductive elements. In another embodiment, a patch antenna is constructed with n sets of transmission lines between the two slots, where each set of transmission line produces a different electrical length in accordance with a particular frequency. In a further embodiment, a set of intermediate filters is added within the transmission lines for differentiating the frequencies. The function of a filter is to pass through a predetermined frequency but rejecting other frequencies, which potentially can destroy the radiation effect.

Advantageously, the present invention reduces the overall dimension of a patch antenna, thereby decreases the overall size of a wireless device. Other structures and methods are disclosed in the detailed description below. This summary does not purport to define the invention. The invention is defined by the claims.

DETAILED DESCRIPTION OF PREFERRED EMBODIMENTS

Figure 1:
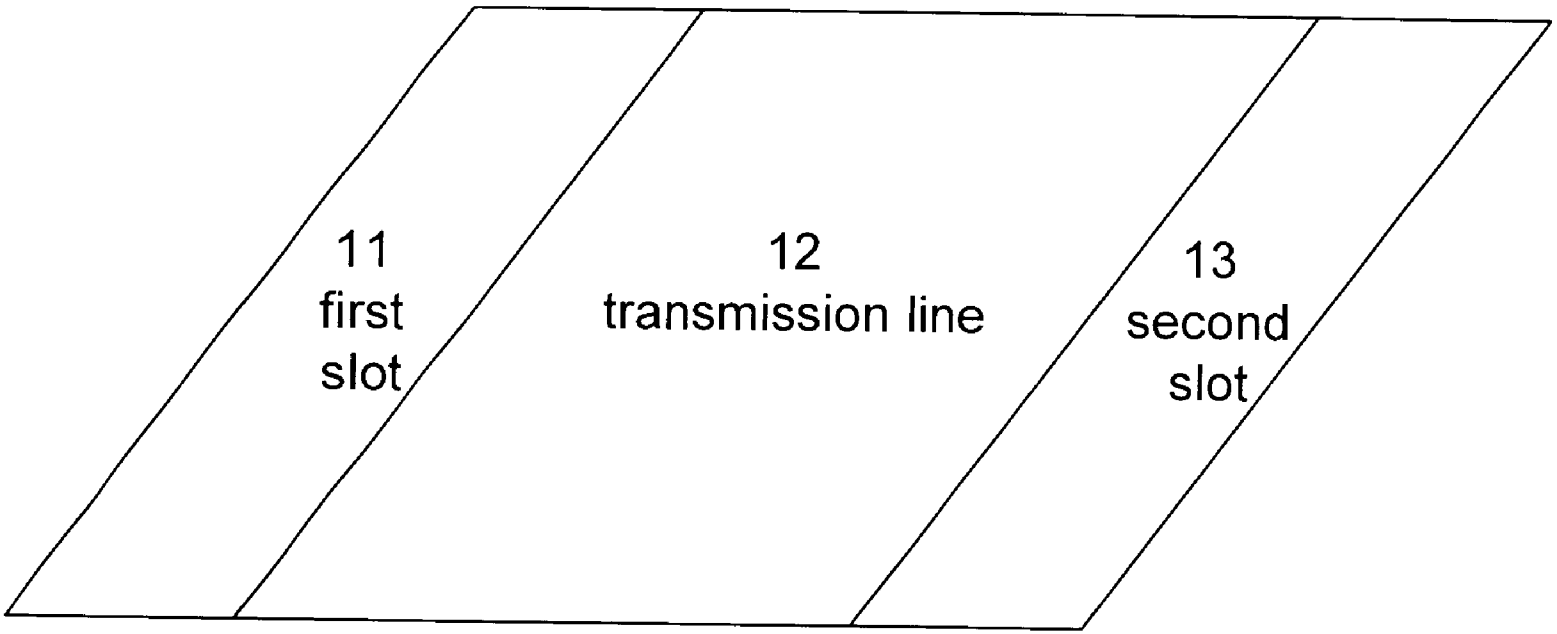
FIG. 1 (Prior Art)
FIG. 1 is a structural diagram illustrating a prior art patch antenna.
Figure 2:
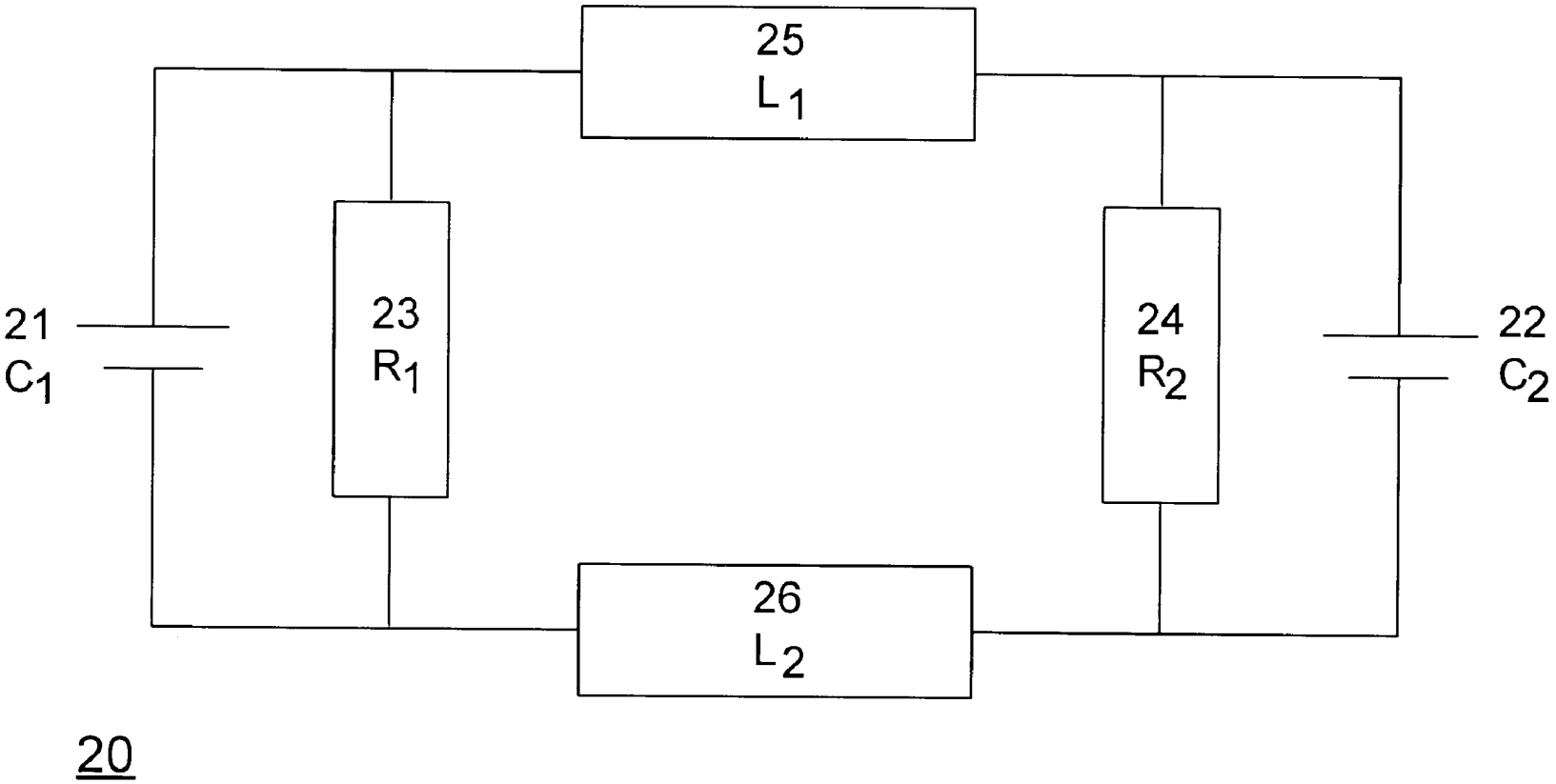
FIG. 2 (Prior Art)
FIG. 2 is a circuit diagram illustrating an equivalent circuit of a prior art patch antenna.
Figure 3:
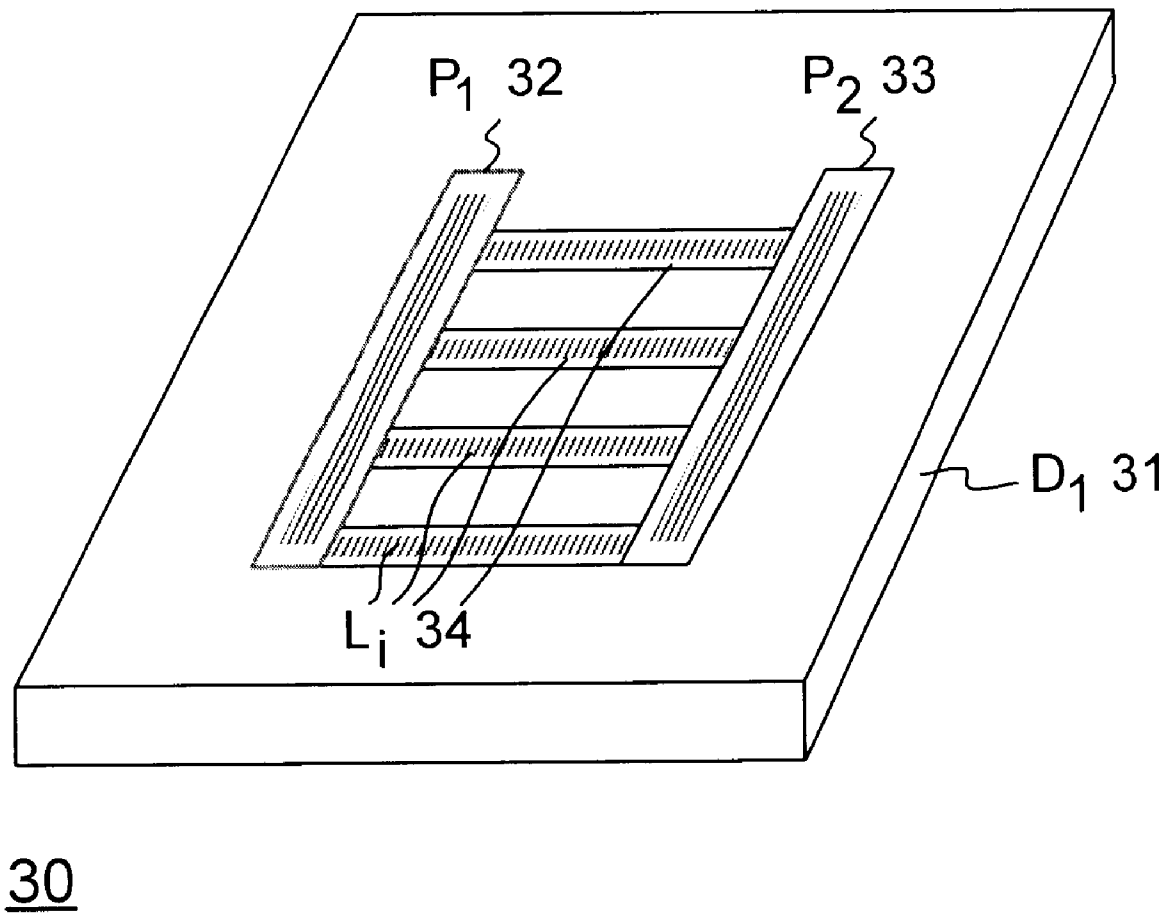
FIG. 3 is a structural diagram illustrating a first embodiment of a compact patch antenna employing a set of transmission lines in accordance with the present invention.

FIG. 3 is a structural diagram illustrating a first embodiment of a compact patch antenna 30 employing a set of transmission lines on a dielectric material D1 31. A set of lines $P_1$ 32 and $P_2$ 33 is printed on the dielectric material D1 31 that serves as radiators. A set of transmission lines Li 34 interconnects between the radiative lines $P_1$ 32 and $P_2$ 33. The number of transmission lines Li 34 depends on the type of application. The use of a set of transmission lines Li 34, rather than a full transmission line, produces cost saving in the manufacturing of the patch antenna 30.

Figure 4:
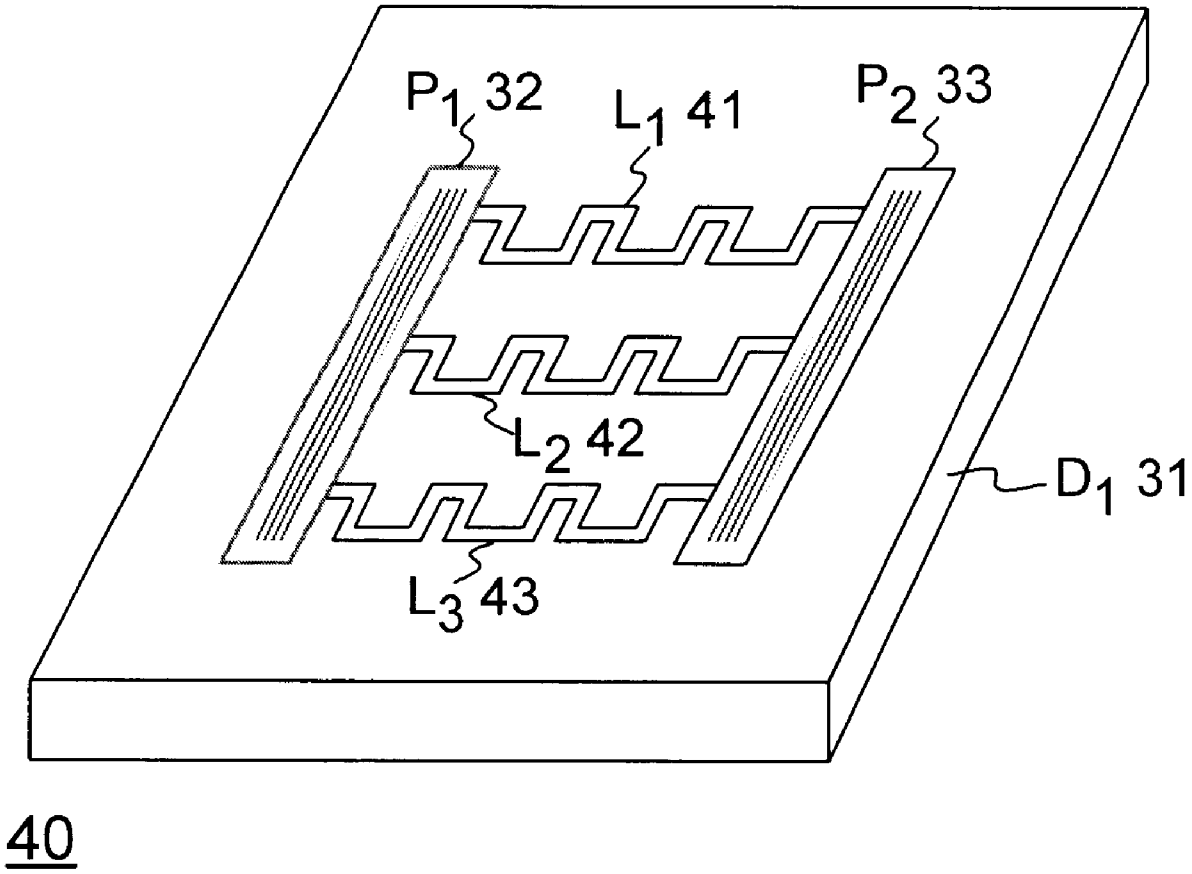
FIG. 4 is a structural diagram illustrating a second embodiment of a compact patch employing cranked transmission lines in accordance with the present invention.

FIG. 4 is a structural diagram illustrating a second embodiment of a compact patch 40 employing cranked or bended transmission lines 41. The bended transmission lines $L_1$ 41, $L_2$ 42, and $L_3$ 43 resemble a rectangular square waveform which conserves the length of transmission lines, thereby reduces the overall size of the patch antenna 40. One of ordinary skill in the art should recognize that various types of bending shapes in transmission lines $L_1$ 41, $L_2$ 42, and $L_3$ 43, such as square or trapezoid waveforms, can be practiced without departing from the spirits in the present invention.

Figure 5:
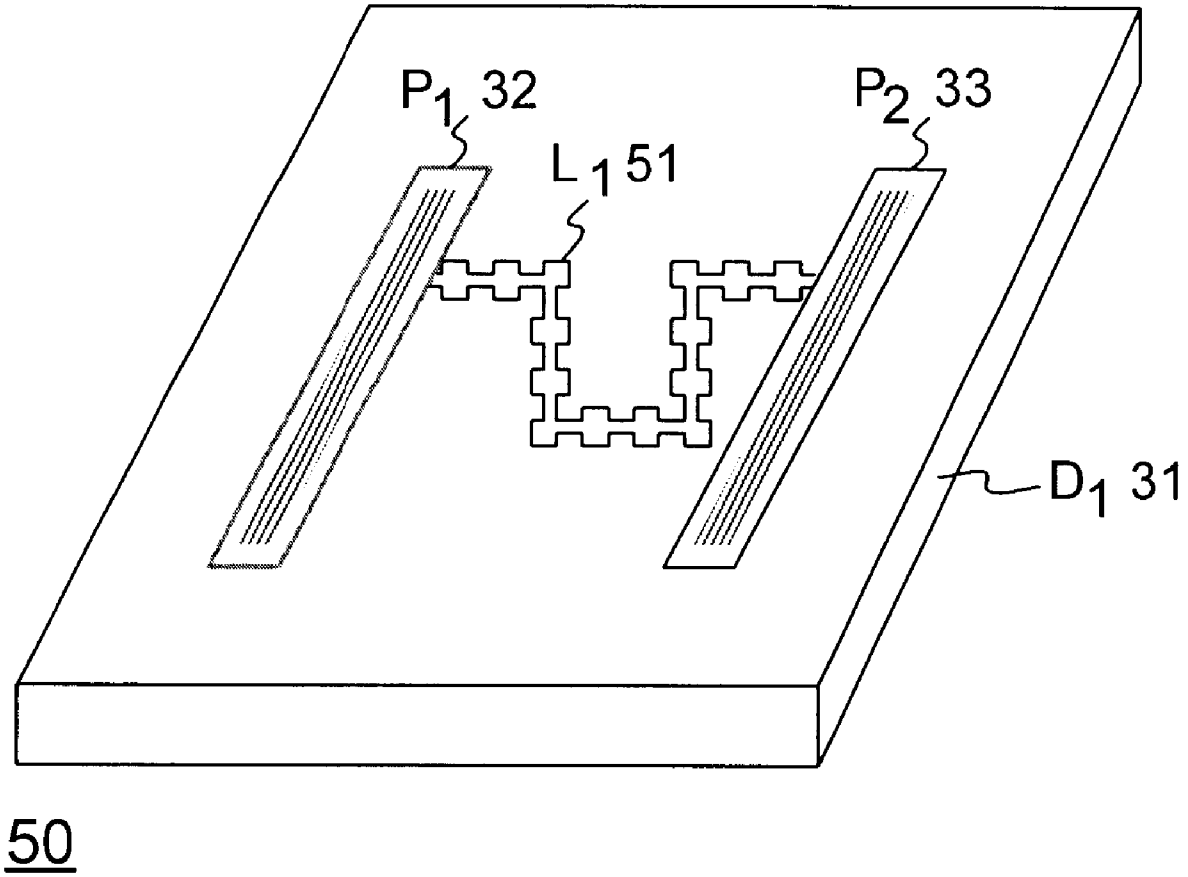
FIG. 5 is a structural diagram illustrating a third embodiment of a compact patch antenna employing a patterned transmission line in accordance with the present invention.
Figure 6:
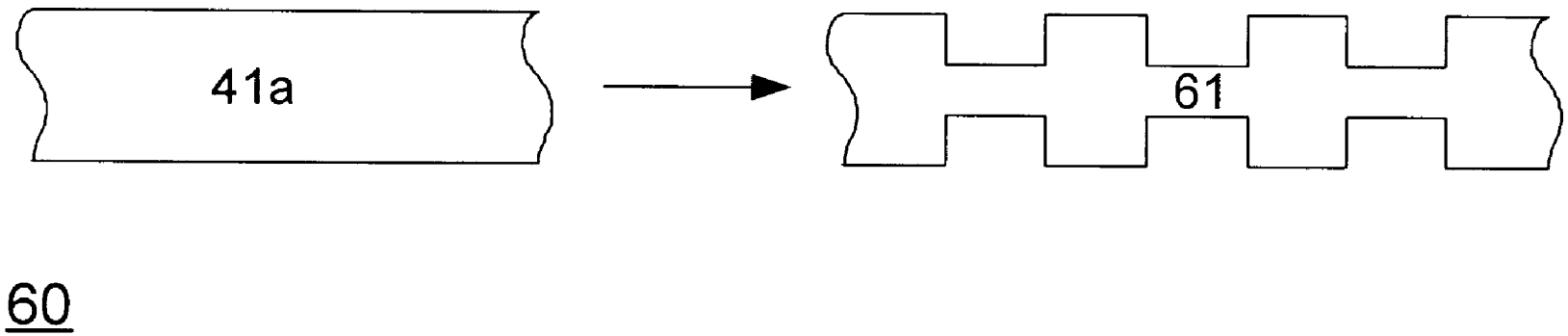
FIG. 6 is an exploded view of the patterned transmission line in accordance with the present invention.

FIG. 5 is a structural diagram illustrating a third embodiment of a compact patch antenna 50 employing a patterned transmission line. The shape of the transmission lines 51 permits more inductive elements in the patch antenna 50, thereby resulting in a quicker shift in $\lambda_g 2$. The exploded view of the patterned transmission line 51 is shown in FIG. 6. A sample segment 41*a* in the transmission line $L_1$ 41 that resembles a rectangular shape or alike is converted into a sample segment 61 in the patterned transmission line 51. The sample segment patterned transmission line 61 has teeth-like patterns. As shown above in relation to FIGS. 4, 5, and 6, the dimension of a compact patch antenna is significantly reduced by the loading of line width inductances or slits, and the cranking of the line.

Figure 7:
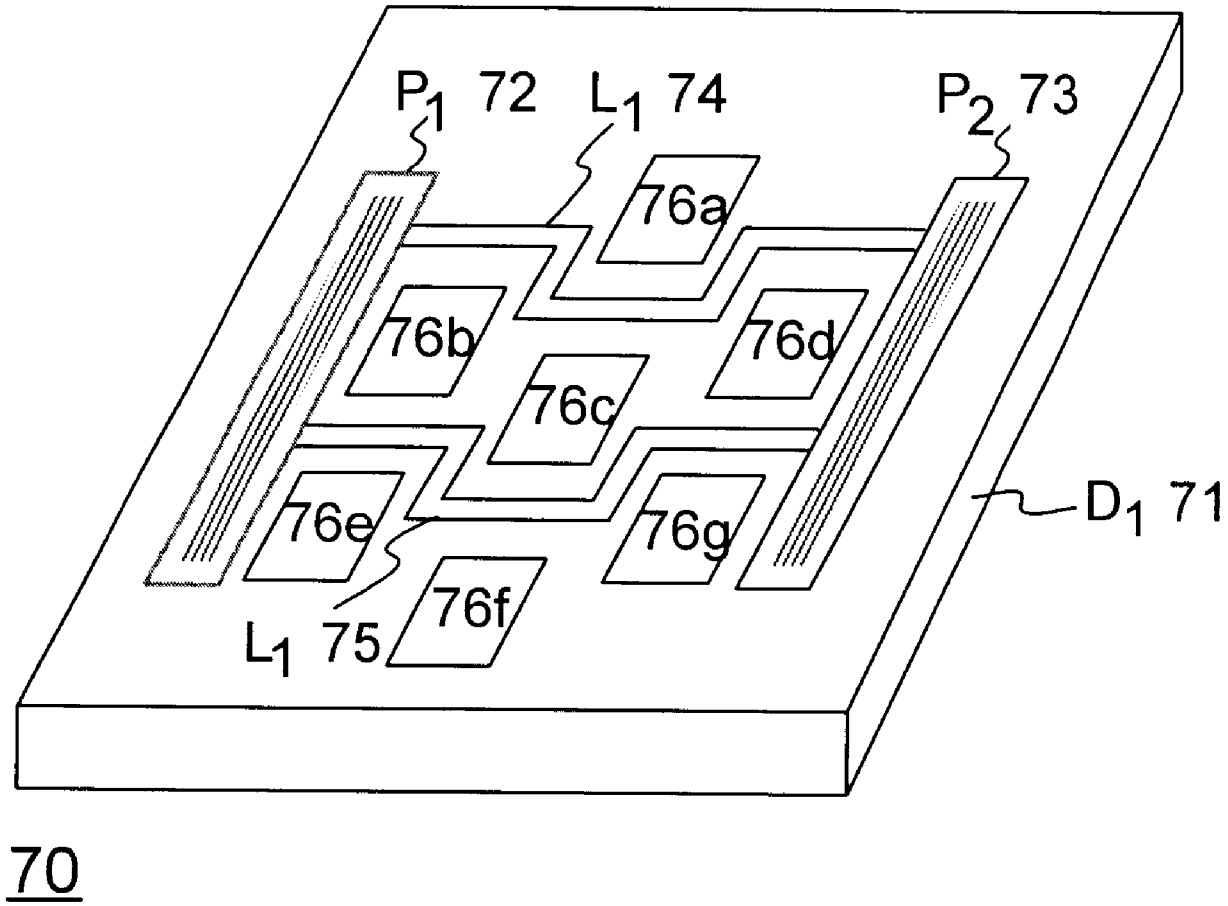
FIG. 7 is a structural diagram illustrating a fourth embodiment of a compact patch antenna with insertable component spacing in accordance with the present invention.

FIG. 7 is a structural diagram illustrating a fourth embodiment of a compact patch antenna 70 with insertable component spacing. The compact patch antenna 70 is fabricated on a multi-layer substrate 71. Transmission lines $L_1$ 74 and $L_2$ 75 are interconnected on each side of radiative lines $P_1$ 72 and $P_2$ 73. The spacing created by the bended transmission lines $L_1$ 74 and $L_2$ 75 allows the insertion of electronic components 76*a*, 76*b*, 76*c*, 76*d*, 76*e*, 76*f*, and 76*g*, to be placed on a circuit board. A dual advantage is provided in this design in which the dimension of the antenna is reduced by the bended transmission line, and the dimension of a circuit board is reduced by the integration of electronic components 76*a*, 76*b*, 76*c*, 76*d*, 76*e*, 76*f*, and 76*g*. It is apparent to one of ordinary skill in the art that other types of components or devices, such as optical components, can be integrated on the compact patch antenna 70.

Figure 8:
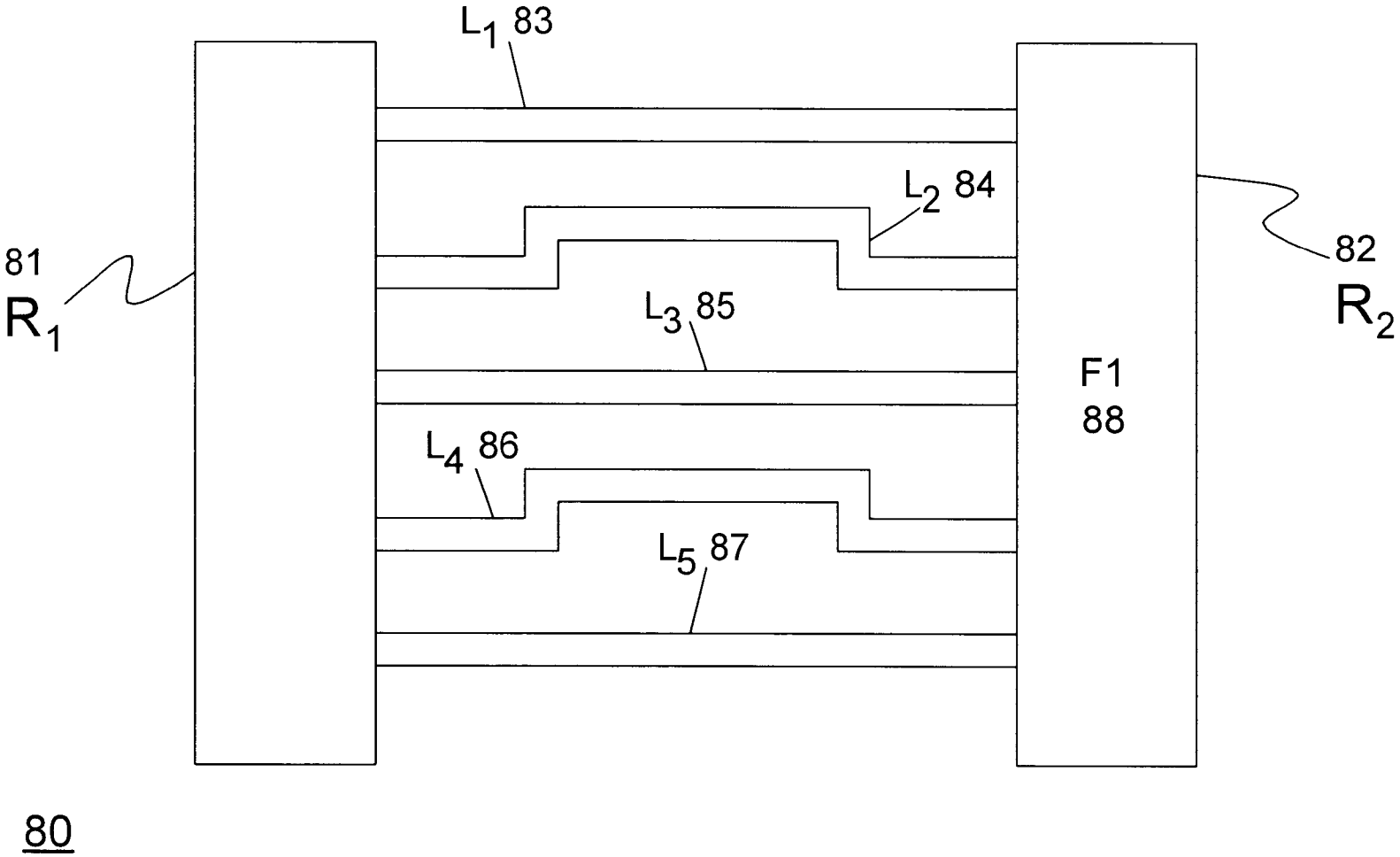
FIG. 8 is a structural diagram illustrating a fifth embodiment of a compact patch antenna with multiple electrical delays in accordance with the present invention.

FIG. 8 is a structural diagram illustrating a fifth embodiment of a compact patch antenna 80 with multiple electrical delays between each of the radiative ends for operation with multiple frequencies. The compact patch antenna 80 has a set of radiative ends $R_1$ 81 and $R_2$ 82. Transmission lines $L_1$ 83, $L_2$ 84, $L_3$ 85, $L_4$ 86, and $L_5$ 87 are interconnected between the two radiative ends $R_1$ 81 and $R_2$ 82. The three straight transmission lines $L_1$ 83, $L_3$ 85, and $L_5$ 87 are dedicated to a working frequency $f_1$ with $$\frac{\lambda_{gl}}{2}.$$

The two cranked transmission lines $L_2$ 84 and $L_4$ 86 have an electrical delay that is longer than the one for $f_1$, producing a lower frequency $f_2$ with $$\frac{\lambda_{g2}}{2}.$$

A feeding point, $F_1$ 88, can be placed, for example, in the center of the radiative end $R_2$ 82, or elsewhere in the compact patch antenna 80. When a signal having a frequency $f_1$ is applied, then the straight transmission lines $L_1$ 83, $L_3$ 85, and $L_5$ 87 ensure that $R_1$ 81 and $R_2$ 82 are connected in an arrangement that produces the maximum efficiency. When a signal having a frequency $f_2$ is applied, the cranked transmission lines $L_2$ 84 and $L_4$ 86 ensure that the correct amount of delay is applied. The design of the transmission lines $L_2$ 84 and $L_4$ 86 should not perturb with the behavior of the compact patch antenna 80 while operating at frequency $f_1$. Similarly, the design of the transmission lines transmission lines $L_1$ 83, $L_3$ 85, and $L_5$ 87 should not perturb with the behavior of the compact patch antenna 80 while operating at frequency $f_2$.

Figure 9:
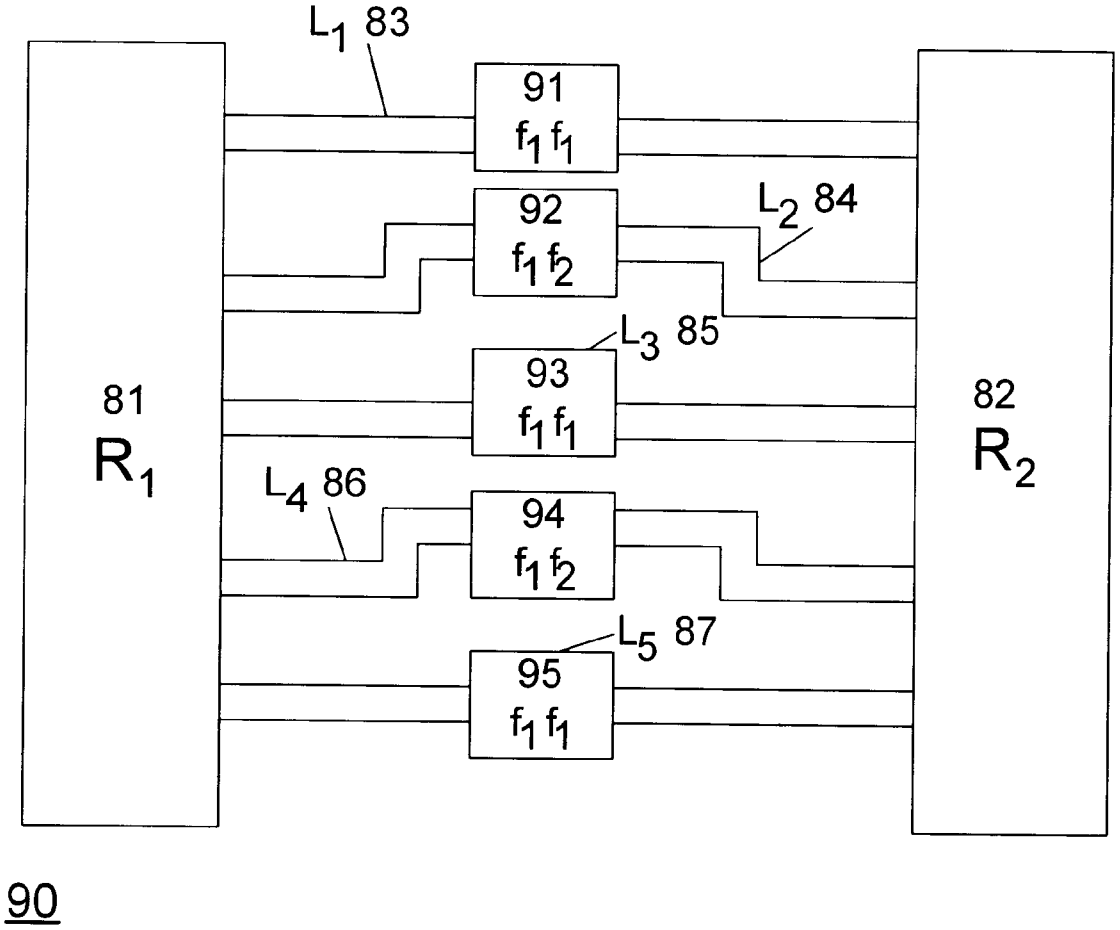
FIG. 9 is a structural diagram illustrating a sixth embodiment of a compact antenna with filters for reducing or eliminating perturbation in accordance with the present invention.

FIG. 9 is a structural diagram illustrating a sixth embodiment of a compact patch antenna 90 with filters for reducing or eliminating perturbation. Filters $f_1f_1$ 91, $f_1f_2$ 92, $f_1f_1$ 93, $f_1f_2$ 94, and $f_1f_1$ 95 are integrated on the compact patch antenna 90 or on a printed circuit board. Each of the filters $f_1f_1$ 91, $f_1f_2$ 92, $f_1f_2$ 93, $f_1f_2$ 94, and $f_1f_1$ 95 serves to reduce the transmission of a frequency. The filter $f_1f_1$ 91 blocks the $f_2$ frequency, the $f_1f_2$ filter 92 blocks the $f_1$ frequency, the filter $f_1f_1$ 93 blocks the $f_2$ frequency, the filter $f_1f_2$ 94 blocks the $f_1$ frequency, and the filter $f_1f_1$ 95 blocks the $f_2$ frequency. If the compact patch antenna 90 operates at frequency $f_1$, then the equivalent circuit comprises two radiative parts of $R_1$ 81 and $R_2$ 82 with the transmission lines $L_1$ 83, $L_3$ 85 and $L_5$ 87. If the compact patch antenna 90 operates at frequency $f_2$, then the equivalent circuit comprises two radiative parts $R_1$ 81 and $R_2$ 82 with the transmission lines $L_2$ 84 and $L_4$ 86.

Figure 10:
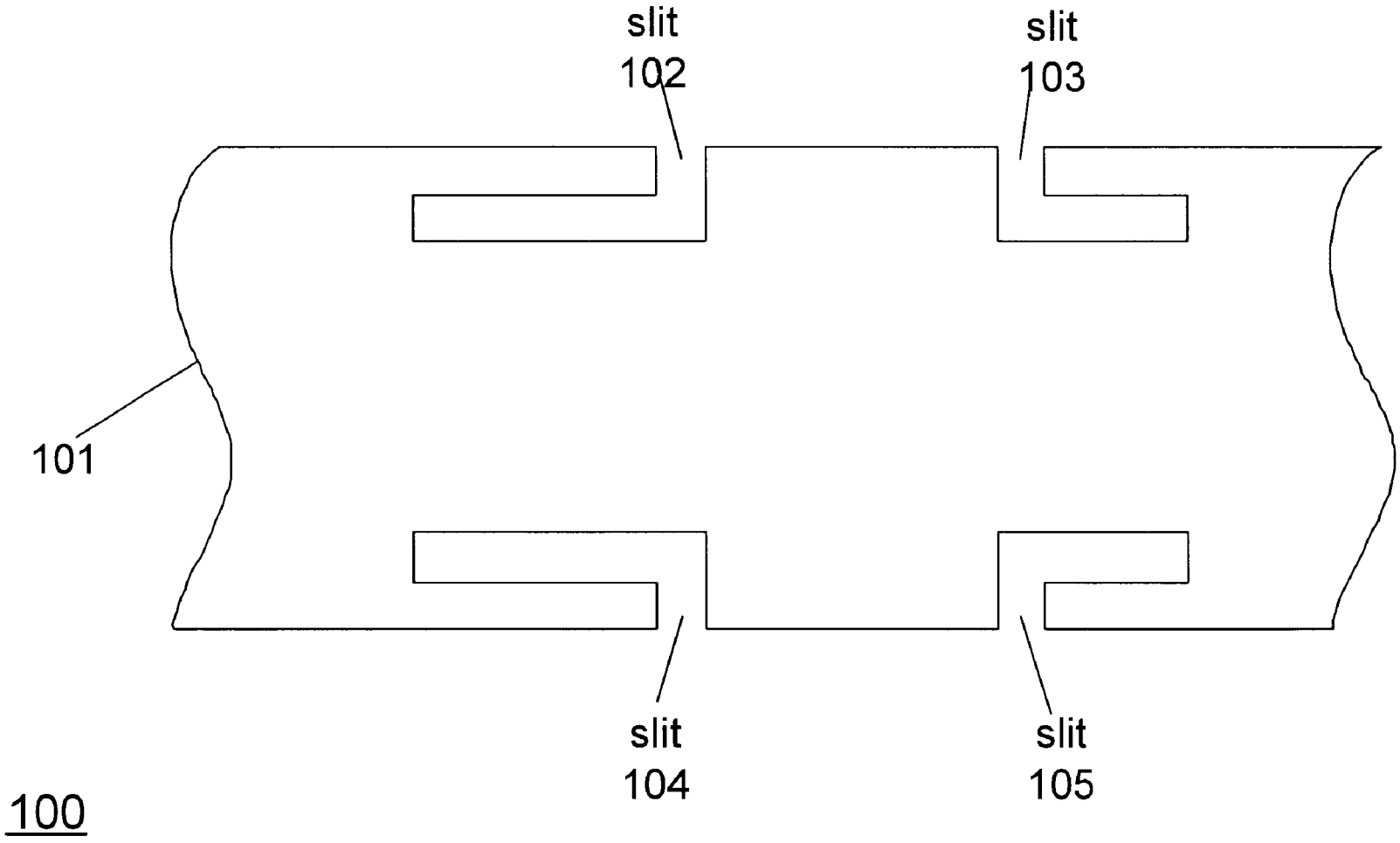
FIG. 10 is a structural diagram illustrating a topology of filters with slits in accordance with the present invention.

FIG. 10 is a structural diagram illustrating a topology of filters 100 with slits 102, 103, 104, and 105. A transmission line 101 is shaped with low pass filters, high pass filters, or band pass filters. For example, if $f_2$ is a lower frequency than $f_1$, a low pass filter is selected for $f_1$ to block out low frequencies, while a high pass filter is used for $f_2$ to block out high frequencies.

Figure 11:
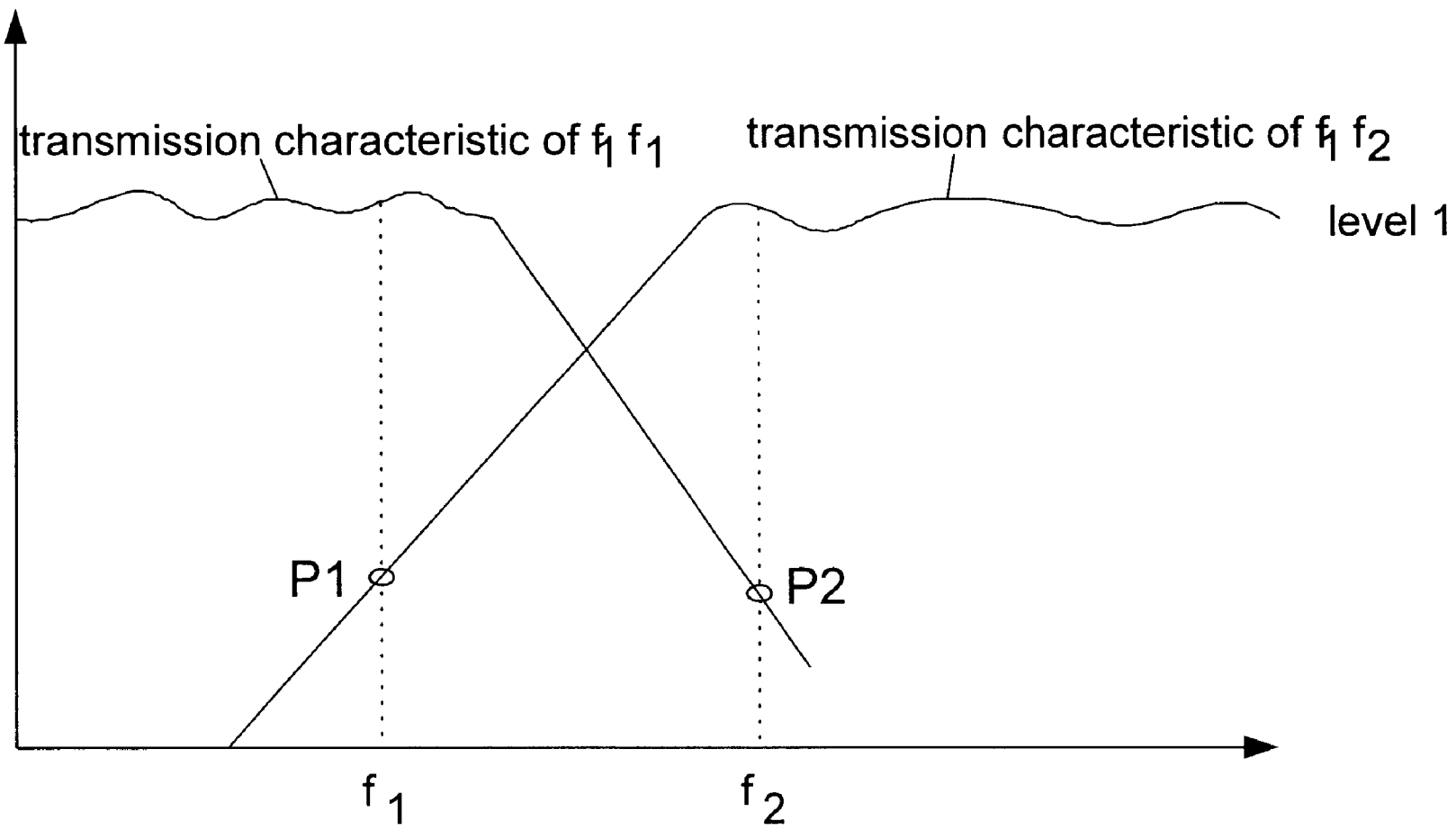
FIG. 11 is a graphical diagram illustrating the transmission characteristics of $f_1$ and $f_2$ in accordance with the present invention.

FIG. 11 is a graphical diagram illustrating the transmission characteristics of $f_1$ and $f_2$. Points p1 and p2 determine the level of rejection in a first frequency relative to a second frequency. Preferably, the points p1 and p2 are selected as low as possible to ensure a desirable isolation exist between the two working modes or frequencies. Consequently, the level of transmission operates at level 1, providing the maximum achievable efficiency in a compact patch antenna structure.

The above embodiments are only illustrative of the principles of this invention and are not intended to limit the invention to the particular embodiments described. For example, although two frequencies are illustrated, one of ordinary skill in the art should recognize that the present invention can be extended beyond two or more frequencies.

Accordingly, various modifications, adaptations, and combinations of various features of the described embodiments can be practiced without departing from the scope of the invention as set forth in the appended claims.

We claim:

1. A patch antenna, comprising:

one or more transmission lines for communication at a first frequency;

one or more transmission lines for communicating at a second frequency, each of the one or more transmission lines of the first frequency being spaced apart from the one or more transmission lines of the second frequency;

one or more rejection filters ($f_1f_1$) of a first type, each of the rejection filters of the first type being placed corresponding to each of one or more transmission lines of first frequency for passing the first frequency ($f_1$) through within the first frequency; and one or more rejection filters of a second type ($f_1f_2$), each of the rejection filters of the second type being placed corresponding to each of one or more transmission lines of second frequency for passing the second frequency ($f_2$) through within the second frequency.

2. The patch antenna of claim 1, further comprising a first radiative slot for coupling to a first end of the one or more transmission lines of first frequency, and for coupling to a first end of the one or more transmission lines of second frequency.

3. The patch antenna of claim 2, further comprising a second radiative slot for coupling to a second end of the one or more transmission lines of first frequency, and for coupling to a second end of the one or more transmission lines of second frequency.

4. The patch antenna of claim 1, wherein each of the one or more transmission lines of first frequency having a minimum straight length.

5. The patch antenna of claim 4, wherein each of the one or more transmission lines of first frequency having a minimum cranked length.

6. The patch antenna of claim 5, wherein each of the one or more transmission lines of second frequency having a straight length that is longer than the minimum straight length of the first frequency, each length of the one or more transmission lines of second frequency being cranked into a length equal to the minimum straight length of the first frequency.

7. The patch antenna of claim 6, wherein each of the one or more transmission lines of second frequency having a straight length that is longer than the minimum cranked length of the first frequency, each length of the one or more transmission lines of second frequency being cranked into a length equal to the minimum cranked length of the first frequency.

8. The patch antenna of claim 7, wherein each of the one or more transmission line of first frequency can be inductively loaded into slots for reducing the minimum straight length; and wherein each of the one or more transmission line of second frequency can be inductively loaded into slits for reducing the minimum straight length.

9. The patch antenna of claim 8, wherein each of the one or more transmission line of second frequency can be inductively loaded into slots for reducing the minimum cranked length; and wherein each of the one or more transmission line of first frequency can be inductively loaded into slots for reducing the minimum cranked length.

10. The patch antenna of claim 1, further comprising at least one electronic component for insertion between any two transmission lines.

* * * * *